US009856107B2

(12) United States Patent
Haipus et al.

(10) Patent No.: US 9,856,107 B2
(45) Date of Patent: Jan. 2, 2018

(54) METHOD FOR HANDLING ERRONEOUS CALLS IN AN ELEVATOR SYSTEM AND AN ELEVATOR SYSTEM

(71) Applicant: KONE CORPORATION, Helsinki (FI)

(72) Inventors: Ilpo Haipus, Nummela (FI); Juha-Matti Kuusinen, Helsinki (FI); Marja-Liisa Siikonen, Helsinki (FI); Janne Sorsa, Helsinki (FI)

(73) Assignee: KONE CORPORATION, Helsinki (FI)

( * ) Notice: Subject to any disclaimer, the term of this patent is extended or adjusted under 35 U.S.C. 154(b) by 528 days.

(21) Appl. No.: 14/546,581

(22) Filed: Nov. 18, 2014

(65) Prior Publication Data

US 2015/0068849 A1 Mar. 12, 2015

Related U.S. Application Data

(63) Continuation of application No. PCT/FI2013/050562, filed on May 23, 2013.

(30) Foreign Application Priority Data

Jun. 4, 2012 (FI) ..... 20125607

(51) Int. Cl.
*B66B 1/16* (2006.01)
*B66B 1/24* (2006.01)
(Continued)

(52) U.S. Cl.
CPC ..... *B66B 1/2408* (2013.01); *B66B 1/3476* (2013.01); *B66B 1/468* (2013.01); *B66B 2201/4684* (2013.01)

(58) Field of Classification Search
CPC ..... B66B 1/2408; B66B 1/3476; B66B 1/468; B66B 2201/1684
(Continued)

(56) References Cited

U.S. PATENT DOCUMENTS 2,776,733 A * 1/1957 Drexler ..... B66B 1/14 187/381
2,779,438 A * 1/1957 Thurston ..... B66B 1/14 187/381
(Continued)

FOREIGN PATENT DOCUMENTS

CA 2 332 727 A1 7/2002
CN 1362934 A 8/2002
(Continued)

*Primary Examiner* — Anthony Salata
(74) *Attorney, Agent, or Firm* — Birch, Stewart, Kolasch & Birch, LLP

(57) ABSTRACT

Method for handling erroneous calls in an elevator system, which includes at least one elevator, call-giving devices for registering calls on the floor levels and/or in the elevator car, and also a control system that responds to the aforementioned calls. One or more calls given by a passenger are registered, it is assessed on the basis of at least one criterion whether some call is erroneous, and at least one corrective action is performed for removing a call, or for rectifying the call data of a call, if the call is ascertained to be erroneous on the basis of the aforementioned criterion.

16 Claims, 1 Drawing Sheet

(51) Int. Cl.
*B66B 1/46* (2006.01)
*B66B 1/34* (2006.01)

(58) Field of Classification Search
USPC ..... 187/247, 380–389, 319, 392, 393, 395, 187/396
See application file for complete search history.

(56) References Cited

U.S. PATENT DOCUMENTS 2,826,751 A 3/1958 Thurston et al.
3,219,151 A 11/1965 Henker
3,292,736 A * 12/1966 Savino ..... B66B 1/20 187/382
3,493,922 A 2/1970 Laas
3,519,102 A 7/1970 Savino
3,556,256 A * 1/1971 Sprague ..... B66B 1/14 187/381
3,616,874 A * 11/1971 Stichweh ..... B66B 1/14 187/381
3,973,649 A * 8/1976 Iwasaka ..... B66B 1/2458 187/387
4,299,309 A * 11/1981 Bittar ..... B66B 1/18 187/381
4,365,694 A * 12/1982 Bittar ..... B66B 1/18 187/381
4,662,479 A * 5/1987 Tsuji ..... B66B 1/2408 187/380
4,735,294 A * 4/1988 Schroder ..... B66B 1/468 187/381
4,782,921 A * 11/1988 MacDonald ..... B66B 1/2458 187/387
4,915,197 A 4/1990 Schroder
5,258,586 A 11/1993 Suzuki et al.
5,949,037 A 9/1999 Oya
5,952,626 A 9/1999 Zaharia
5,975,247 A 11/1999 Choi
5,984,051 A * 11/1999 Morgan ..... B66B 1/468 187/316
6,109,396 A * 8/2000 Sirag ..... B66B 1/468 187/381
6,209,685 B1 4/2001 Zaharia et al.

FOREIGN PATENT DOCUMENTS

FI 112069 B 10/2003
JP 64-2983 A 1/1989
JP 2010-111444 A 5/2010
WO WO 2010/061427 A1 6/2010

* cited by examiner

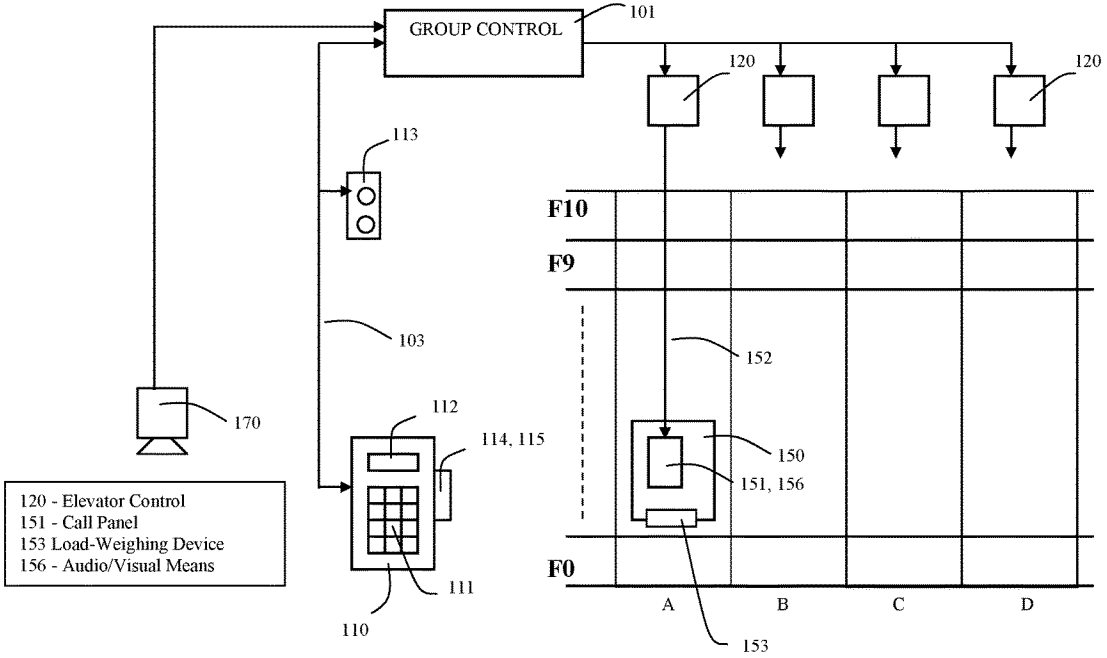
GROUP CONTROL
101
120
120
F10
F9
F0
A
B
C
D
152
150
151, 156
153
113
103
112
114, 115
111
110
170
120 - Elevator Control
151 - Call Panel
153 Load-Weighing Device
156 - Audio/Visual Means

METHOD FOR HANDLING ERRONEOUS CALLS IN AN ELEVATOR SYSTEM AND AN ELEVATOR SYSTEM

CROSS REFERENCE TO RELATED APPLICATIONS

This application is a Continuation of PCT International Application No. PCT/FI2013/050562 filed on May 23, 2013, which claims priority under 35 U.S.C. §119(a) to Patent Application No. 20125607 filed in Finland on Jun. 4, 2012, all of which are hereby expressly incorporated by reference into the present application.

FIELD OF THE INVENTION

The invention relates to elevator systems. More particularly the invention relates to an elevator system and to a method for rectifying, or removing from a plurality of calls to be served, erroneous calls given by passengers.

BACKGROUND OF THE INVENTION

Passengers using elevators can give erroneous elevator calls for many different reasons. A passenger can, for example, accidentally give a destination call to a floor to which he/she is not traveling. In this case he/she has to give a new call to the floor to which he/she is actually going. Some passengers can also deliberately give an erroneous call e.g. in order to receive an empty elevator car for their use. In some cases malicious damage can even be related to calls, e.g. when a person in an elevator car presses all the call pushbuttons and immediately leaves the elevator car. Calls erroneously given in elevator systems according to prior art are generally served as also the other calls, as a consequence of which the transport capacity of the elevator systems declines and the arrival of passengers at their destination is delayed. Another problem is that a passenger that gave an erroneous call can receive a special service, which has an adverse effect on the service received by other passengers. There is thus a need for a solution that identifies and, if necessary, changes or removes erroneous calls in an elevator system.

AIM OF THE INVENTION

The aim of the present invention is to eliminate or at least to alleviate the aforementioned drawbacks that occur in prior-art solutions.

SUMMARY OF THE INVENTION

The method according to the invention is characterized by what is disclosed in the characterization part of claim 1. The elevator system according to the invention is characterized by what is disclosed in the characterization part of claim 8. Other embodiments of the invention are characterized by what is disclosed in the other claims. Some inventive embodiments are also presented in the drawings in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

The basic idea of the invention is to identify erroneous calls, which passengers give in elevator lobbies and/or in elevator cars, and on the basis of the identification to perform corrective actions to the registered calls.

According to a first aspect of the present invention a method is presented for handling erroneous calls in an elevator system, which comprises at least one elevator, call-giving devices for registering calls on the floor levels and/or in an elevator car, and also a control system that responds to the aforementioned calls. According to the invention one or more calls given by a passenger are registered, it is assessed on the basis of at least one criterion whether one or more of the aforementioned calls are erroneous. If one or more calls, on the basis of the aforementioned criterion, are erroneous at least one corrective action is performed for rectifying the aforementioned one or more calls or for removing them from the plurality of calls to be served. Removing a call refers in this context to the elevator system deleting the call data from the list of calls to be served. Rectifying a call refers in this context to correcting the data to be connected to the call.

In one embodiment of the invention a first call is identified as erroneous if, within the given time window from the first call, a second call with the same call-giving device is registered. The corrective action in this case is removal of the first call from the plurality of calls to be served. As a result of the embodiment, a situation in which a passenger gives a second call fairly immediately after a first call can be observed. A time window is preferably selected to be so short that during that time there is probably insufficient time for a passenger to leave the call-giving device and for the next passenger to give his/her own call from the same call-giving device.

In one embodiment of the invention the elevator system is provided with observation means in an elevator lobby and/or on the call-giving devices (in front of the call-giving devices) for observing passengers and the observation data produced by these is used in assessing the erroneousness of calls. On the basis of the observation data it is deduced e.g. whether the same passenger using one or more call-giving devices gives a number of calls in the same elevator lobby and/or in the elevator car. If on the basis of the observation data that is the case, the calls of the passenger in question are removed from the plurality of calls to be served except for the very last call. For example, cameras disposed in an elevator lobby and/or in an elevator car and/or proximity sensors in connection with the call-giving devices can be used in as observation means. As a result of the embodiment, situations can be detected in which a passenger, after having given a first call, decides to travel e.g. to some other floor than that to which he/she was originally traveling. Since observation data is utilized in the embodiment, the time between the calls can be significantly longer than the time window used in the embodiment mentioned in the preceding.

In another embodiment of the invention the group size of a passenger group, to which passenger group the passenger who gave the call belongs, is deduced on the basis of the observation data. In the embodiment the group size registered in connection with the aforementioned call is compared to the group size determined on the basis of the observation data, and if the group sizes differ from each other by more than a given threshold value, the registered group size is rectified to correspond to the group size determined on the basis of the observation data. The group size can be rectified if the registered group size is too large or too small compared to the group size determined on the basis of the observation data. As a result of the embodiment, situations in which a passenger traveling alone gives a group call in order to obtain an emptier elevator car for his/her use can be prevented.

In another embodiment of the invention a handicapped-accessible transport request is registered in connection with a call, it is deduced, on the basis of the observation data, whether the passenger who gave the call is really e.g. a physically-handicapped person using a wheelchair. The handicapped-accessible transport request is removed from the registered call, if the passenger who gave the call is not, on the basis of the observation data, a passenger using a wheelchair. As a result of the embodiment, the registration of needless handicapped-accessible transport requests can be prevented.

In one embodiment of the invention the elevator system is provided with calculation means for determining the number of passengers in an elevator car. In the embodiment one or more feedback actions are performed, if the number of active (to be served) calls, so-called car calls, so-called car commands, given in the elevator car is greater than the number of passengers detected in the elevator car with the calculation means. In the embodiment e.g. a visual and/or auditive instruction can be given to the passengers in the elevator car to countermand, i.e. to cancel, surplus calls before the elevator car starts moving. As a result of the embodiment, calls that would cause needless stops for the elevator car, and would thus delay the arrival of passengers at their destinations, can be removed from the plurality of calls to be served. Countermanding a call can be done e.g. manually by pressing for a pre-defined time an active car command button that by pressing which the call was originally activated.

The present invention also presents an elevator system, which comprises at least one elevator, call-giving devices for registering calls on the floor levels and/or in an elevator car, and also a control system that responds to the aforementioned calls. The control system is arranged to register one or more calls given by a passenger, to assess on the basis of at least one criterion given in advance whether one or more of the aforementioned calls are erroneous and to perform at least one corrective action for rectifying or removing the aforementioned call, if the control system assesses that the aforementioned one or more calls are erroneous on the basis of the aforementioned criterion.

A call refers in this context to a call given with conventional up/down-pushbuttons in an elevator lobby, a destination call given with a destination call terminal or a car call given in an elevator car. A call can also be given with a personal terminal device, e.g. with a mobile phone, or with a personal access card (ID card). If the call is destination call, the call comprises information about the departure floor and about the destination floor of the passenger. Information about the group size of a passenger group can be connected to a destination call. A handicapped-accessible transport request and/or a so-called VIP transport request can also be connected to a destination call. If the call is a call given with up/down pushbuttons, the call comprises information about the departure floor of the passenger and also about the direction of travel. An elevator system can comprise different types of call-giving devices on different floors, e.g. in such a way that on congested floors destination call terminals are used and on other floors up/down-pushbuttons.

With the solution according to the invention numerous advantages are achieved compared to prior-art solutions. One advantage, among others, of the present invention is that erroneous calls given, either deliberately or accidentally, by passengers can be removed from the plurality of calls to be served or the call data to be connected to a call can be changed in such a way that the call data better corresponds to the actual service need. As a result of the invention the transport capacity of the elevator system remains optimal while at the same time the waiting times of passengers become shorter and arrival at destination becomes faster. The elevator service is also more equitable for all passengers, because individual passengers cannot reserve a service for themselves that does not belong to them.

LIST OF FIGURES

In the following, the invention will be described in detail by the aid of a few examples of its embodiments, wherein:

FIG. 1 presents an elevator system according to the invention.

DETAILED DESCRIPTION OF THE INVENTION

FIG. 1 presents an elevator group according to the invention, which group comprises four elevators A, B, C and D, which serve the floors F0, F1 . . . F10 of a building. A destination call terminal 110, which is connected via a device bus 103 to the group control 101 of the elevator group, is installed in the entrance lobby F0. In the other elevator lobbies F1-F10 are conventional up/down pushbuttons 113 for calling an elevator to the floor. In the elevator car 150 of elevator A is a call panel 151 for giving car calls in the elevator car. In connection with the call panel 151 are audio-visual means 156 for giving auditive and/or visual instructions to passengers in the elevator car. In addition, the load-weighing device, which measures the car load in the car, is marked with the reference number 153. The call panel 151, the load-weighing device 153 and the other necessary modules are connected to the elevator control 120 via a device bus 152. Correspondingly, in the elevator cars of elevators B, C, and D there is a call panel 151 and a load-weighing device 153, which are connected with a corresponding device bus to the elevator controls 120 (not presented in FIG. 1). The destination call terminal 110 comprises pushbuttons 111 for giving destination calls and also a so-called group call pushbutton for registering the size of a passenger group and also a handicapped-accessible transport request pushbutton for passengers moving in wheelchairs. The call-giving devices 110, 113 and/or 151 can be provided with ID card readers 115, by means of which a passenger can give a call to the elevator system by presenting his/her ID card to aforementioned the reader. Giving a call using an ID card (access card) is per se prior art, and it is not presented more closely in this context. The number and placement of the call-giving devices on the floors can be vary on a case-by-case basis, e.g. an extra destination call terminal can be disposed in the proximity of the entrance of the entrance lobby F0, in which case a passenger can give a destination call in good time before arriving at the elevators. If the elevator system is a so-called full-destination elevator system, call panels 151 are not necessarily needed in the elevator cars. When a passenger gives from a destination call terminal 110, the group control 101 registers the departure floor (the floor from which the call was given) of the passenger and also the destination floor (the floor to which the passenger is going). Based on the call data, the group control allocates an elevator serving the passenger, which elevator is notified to the passenger e.g. on a display 112 of the destination call terminal 110. The group control sends to the group control 120 the run commands of the allocated elevator for collecting the passenger from the call-giving floor and for taking the passenger to the destination floor.

Marked in FIG. 1 with the reference number 114 is an observation means, e.g. a proximity sensor, in connection with the destination call terminal, which observation means gives information when a passenger giving a call is at the call device. Further, marked in FIG. 1 with the reference number 170 are observation means, e.g. a camera, infrared detector, RF sensor operating at radio frequencies, or other monitoring device or monitoring system suited to the purpose, by means of which the movements of passengers in an elevator lobby or in an elevator car and/or by means of which passengers moving in groups can be monitored. FIG. 1 presents only one observation means 170, but there can be a number of them in the elevator lobbies and/or in the elevator cars. In FIG. 1 integrated into the observation means 170 is its own people-counting processor, which is connected directly to the group control via a suitable data transfer connection but it is obvious to the person skilled in the art that one or more observation means 170 can be connected to a separate people-counting system, which is further connected to the group control for sending observation data to the group control.

According to the invention a passenger gives a first call in an elevator lobby or in an elevator car. After the first call, the passenger can give a new call in the same elevator lobby or in the elevator car. The group control 101 and/or the elevator control controls 120 assess, on the basis of given criteria, whether any of the calls given by the passenger are possibly erroneous. The criteria are e.g. any of the following criteria:

A time parameter, which determines the minimum time (so-called time window) between consecutive calls given with the same call-giving device 110 or 151, is recorded in the control system 110 and/or 120. If consecutive calls are registered in a shorter time than the aforementioned time parameter, it is assumed that the same passenger has given the calls, in which case the other calls given by him/her, except for the very last registered call, can be removed from the plurality of calls to be served.

The call-giving devices are provided with observation means, on the basis of the observation data produced by which it can be deduced whether the same passenger gives a number of consecutive calls from the same call-giving device without leaving the call-giving device between the calls. If on the basis of the observation data the same passenger gives a number of consecutive calls from the same call-giving device, the other calls, except for the very last registered call, can be removed from the plurality of calls to be served. For example, proximity sensors 114 in connection with call-giving devices and/or observation means 170 in an elevator lobby or in the elevator cars can be used as observation means.

The elevator lobbies and/or elevator cars are provided with observation means, on the basis of the observation data produced by which the movements of each passenger can be monitored and it can be deduced whether the same passenger gives a number of consecutive calls with different call-giving devices in the same elevator lobby and/or in the elevator car. If the same passenger gives a number of consecutive calls from different call-giving devices, the other calls, except for the very last registered call, can be removed from the plurality of calls to be served. For example, cameras 170 and/or reading devices 115 of ID cards can be used as observation means.

The elevator lobbies are provided with observation means 170, on the basis of the observation data produced by which the group size of a passenger group can be deduced. When a passenger belonging to a passenger group gives a group call in an elevator lobby from the destination call terminal 110, the group size registered in connection with the group call is compared to the group size determined on the basis of the observation data, and if the group sizes differ from each other by more than a given threshold value, the registered group size is rectified to correspond to the group size determined on the basis of the observation data. For example, one or more cameras 107 can be used in an elevator lobby as observation means.

The elevator system is provided with calculation means for determining the number of passengers in the elevator car 150. If the number of active (to be served) car calls given in the elevator car is greater than the number of passengers in the elevator car detected with the calculation means, one or more feedback actions are performed, e.g. the starting of the elevator car is prevented and/or the elevator system gives an auditive and/or visual instruction to passengers in the elevator car to countermand the surplus car calls. For example, the load-weighing device 153 of the elevator car and/or a door photocell of the elevator car can be used as calculation means. Countermanding a call can occur e.g. by pressing for a pre-defined time a car command button that is active. The activation data of a call, e.g. the halo or the 'ON' color of the car command button, disappears when the call has been countermanded.

The elevator lobbies and/or call-giving devices are provided with observation means, on the basis of the observation data produced by which it can be deduced whether the passenger who gave the call is a passenger using a wheelchair. If, on the basis of the observation data, the passenger is not physically handicapped, the handicapped-accessible transport request is removed if the request in question is registered in connection with the call. The observation means can be e.g. one or more cameras 170.

One or more call-giving devices are provided with ID card reader devices 115. An ID card comprising an individual ID code to be read with the aforementioned reader device is given to each passenger using the elevator system. When a passenger takes his/her ID card to a reader device, the passenger is identified on the basis of the data read from the ID card. The group control of the elevator system or the access control system that is in connection with the elevator system in this case generates a destination call e.g. to the home floor of the passenger, which call the group control registers. After this the elevator system and/or the access control system can deduce whether the same passenger gives new calls in the same elevator lobby using an ID card and can remove the other calls given with the ID card of the passenger except for the very latest call.

It is obvious to the person skilled in the art that different embodiments of the invention are not limited to the example described above, but that they may be varied within the scope of the claims presented below. For example, also other than proximity sensors and/or cameras can be used as observation means, e.g. radars, detection-sensitive carpets disposed on the floor surface, et cetera.

The invention claimed is:

1. A method for handling erroneous calls in an elevator system, the elevator system comprising at least one elevator, call-giving devices for registering calls on floor levels and/or in an elevator car, and a control system that responds to the calls, said method comprising the steps of:

registering one or more calls given by a passenger;

assessing on the basis of at least one given criterion whether one or more of the calls are erroneous;

performing at least one corrective action for removing the one or more erroneous calls or for rectifying the call data of the one or more erroneous calls, if the one or more calls are ascertained to be erroneous on the basis of the at least one criterion; and providing the elevator system with an observation device configured to observe passengers moving in an elevator lobby and/or using call-giving devices;

deducing on the basis of the observation data whether the same passenger gives consecutive calls with one or more call-giving devices in the same elevator lobby; and if a passenger gives the consecutive calls, removing the calls from the plurality of registered calls except for the very last call.

2. The method according to claim 1, further comprising the step of identifying at least one first registered call as erroneous if, within the given time window from the first call, a second call with the same call-giving device is registered.

3. The method according to claim 2, further comprising the steps of:

providing the elevator system with an observation device configured to observe passengers moving in an elevator lobby and/or using call-giving devices;

deducing on the basis of the observation data whether the same passenger gives consecutive calls with one or more call-giving devices in the same elevator lobby; and if a passenger gives the consecutive calls, removing the calls from the plurality of registered calls except for the very last call.

4. The method according to claim 2, further comprising the steps of:

providing at least one elevator lobby with an observation device;

deducing the group size of a passenger group on the basis of the observation data produced by the observation device;

comparing the group size given in connection with a call of a passenger belonging to the passenger group to the group size determined on the basis of the observation data; and if the group sizes differ from each other by more than a given threshold value, rectifying the group size registered in connection with the call to correspond to the group size determined on the basis of the observation data.

5. The method according to claim 2, further comprising the steps of:

providing the elevator system with a calculation device configured to determine the number of passengers in an elevator car;

registering the calls given by passengers in the elevator car; and if the number of active calls given in the elevator car is greater than the number of passengers in the elevator car detected with the calculation device, performing one or more feedback actions for removing the surplus calls.

6. The method according to claim 1, further comprising the steps of:

providing at least one elevator lobby with an observation device;

deducing the group size of a passenger group on the basis of the observation data produced by the observation device;

comparing the group size given in connection with a call of a passenger belonging to the passenger group to the group size determined on the basis of the observation data; and if the group sizes differ from each other by more than a given threshold value, rectifying the group size registered in connection with the call to correspond to the group size determined on the basis of the observation data.

7. The method according to claim 6, further comprising the steps of:

providing the elevator system with a calculation device configured to determine the number of passengers in an elevator car;

registering the calls given by passengers in the elevator car; and if the number of active calls given in the elevator car is greater than the number of passengers in the elevator car detected with the calculation device, performing one or more feedback actions for removing the surplus calls.

8. The method according to claim 1, further comprising the steps of:

providing the elevator system with a calculation device configured to determine the number of passengers in an elevator car;

registering the calls given by passengers in the elevator car; and if the number of active calls given in the elevator car is greater than the number of passengers in the elevator car detected with the calculation device, performing one or more feedback actions for removing the surplus calls.

9. The method according to claim 8, wherein a surplus call is countermanded by pressing for a pre-defined time the car command button that by pressing which the call was activated.

10. The method according to claim 1, further comprising the steps of:

providing at least one elevator lobby and/or call-giving device with an observation device configured to observe passengers using wheelchairs;

preventing the registration of a handicapped-accessible transport request in connection with a call if the passenger who gave the call is not, on the basis of the observation data produced with the observation device, a passenger using a wheelchair.

11. An elevator system, comprising:

at least one elevator;

call-giving devices for registering calls on the floor levels and/or in the elevator car; and a control system that responds to the calls, wherein the control system is arranged to register one or more calls given by a passenger, to assess on the basis of at least one criterion given in advance whether one or more of the calls are erroneous, and to perform at least one corrective action for removing, or for rectifying the call data of, the one or more erroneous calls, if the control system ascertains that the one or more calls are erroneous on the basis of the at least one criterion, wherein the elevator system comprises an observation device, on the basis of the observation data produced by which the control system is arranged to deduce whether the same passenger has given consecutive calls in the same elevator lobby and if the same passenger has, the calls are removed except for the very last call.

12. The elevator system according to claim 11, wherein the control system is arranged to remove consecutive calls given inside a given time window with the same call-giving device except for the very last call.

13. The elevator system according to claim 11, wherein the elevator system comprises another observation device, on the basis of the observation data produced by which the control system is arranged to determine the group size of a passenger group, to compare the group size to the group size registered in connection with the call-giving, and to rectify the registered group size to correspond to the group size determined on the basis of the observation data, if the group sizes differ from each other by more than a given threshold value.

14. The elevator system according to claim 11, wherein the elevator system comprises a calculation device configured to determine the number of passengers in an elevator car and for comparing it to the number of active calls given in the elevator car, and to perform one or more feedback actions if the number of calls is greater than the number of passengers in the elevator car.

15. The elevator system according to claim 14 wherein the feedback action comprises an auditive and/or visual instruction given with an audiovisual device to passengers in the elevator car for countermanding surplus calls.

16. The elevator system according to claim 14, wherein the control system is arranged to cancel a call given in an elevator car when a passenger presses for a pre-defined time the car command button that by pressing which the call was activated.

* * * * *